US007221253B2

(12) United States Patent
Kim et al.

(10) Patent No.: US 7,221,253 B2
(45) Date of Patent: May 22, 2007

(54) FUSIBLE RESISTOR AND METHOD OF FABRICATING THE SAME

(75) Inventors: Young Sun Kim, Pusan (KR); Doo Won Kang, Ulsan (KR); Gyu Jin Ahn, Ulsan (KR); Jin Seok Noh, Pusan (KR)

(73) Assignee: Smart Electronics Inc., Ulsan (KR)

( * ) Notice: Subject to any disclaimer, the term of this patent is extended or adjusted under 35 U.S.C. 154(b) by 158 days.

(21) Appl. No.: 10/519,692

(22) PCT Filed: Jul. 9, 2002

(86) PCT No.: PCT/KR02/01295

§ 371 (c)(1),
(2), (4) Date: Dec. 27, 2004

(87) PCT Pub. No.: WO2004/006273

PCT Pub. Date: Jan. 15, 2004

(65) Prior Publication Data

US 2005/0248433 A1 Nov. 10, 2005

(51) Int. Cl.
*H01C 7/10* (2006.01)

(52) U.S. Cl. ..... 338/24; 338/22 R; 338/307

(58) Field of Classification Search ..... 338/24, 338/307–309, 324, 325, 22 R, 195, 295; 428/432, 433, 446; 29/612; 257/678, 433; 136/256

See application file for complete search history.

(56) References Cited

U.S. PATENT DOCUMENTS

| | | | | |
|---|---|---|---|---|
| 4,031,497 | A | 6/1977 | Ozawa | 338/308 |
| 4,038,457 | A * | 7/1977 | Kinugasa et al. | 338/308 |
| 4,401,963 | A | 8/1983 | Duenke | 337/282 |
| 5,431,718 | A * | 7/1995 | Lombard et al. | 106/1.14 |
| 6,313,521 | B1 * | 11/2001 | Baba | 257/678 |
| 6,479,744 | B1 * | 11/2002 | Tsuzuki et al. | 136/256 |

FOREIGN PATENT DOCUMENTS

JP 64-53504 3/1989

* cited by examiner

*Primary Examiner*—Tu Hoang
(74) *Attorney, Agent, or Firm*—Ladas & Parry LLP

(57) ABSTRACT

A fusible resistor and method of fabricating the same is provided. The fusible resistor has a very low resistance of 20 to 470 mΩ. by depositing thin films as a fusible element made of a material with low resistivity such as copper having a temperature coefficient of over 2,000 ppm/° C. The fusible resistor comprises a resistor body, a fusible element layer formed to surround the resistor body, caps formed to surround ends of the fusible element layer, lead wires attached to the caps, and an insulating layer for insulating the fusible element layer and the caps from outside. The thus-fabricated fusible resistor performs all functions of a use without generating excessive heat.

18 Claims, 7 Drawing Sheets

FUSIBLE RESISTOR AND METHOD OF FABRICATING THE SAME

TECHNICAL FIELD

The present invention relates to a fusible resistor and method of fabricating the same, and more particularly to a fusible resistor that is inexpensive and has excellent electrical characteristics and method of fabricating the same.

BACKGROUND ART

In general, fusible resistors are used to protect circuit elements of electronic devices. A fusible resistor functions as an ordinary resistor at normal loads, but as circuit breakers in an abnormal, overload state, due to its fusible characteristics.

Conventional fusible resistors are fabricated by coating a resistor body with a thin film made of a compound consisting of carbon, tin-nickel, and nickel-chrome by electroless plating and by performing a spiral cut on the surface of the coated resistor body (hereinafter, the spiral cutting will be referred to as "trimming"). While inexpensive fabrication of conventional fusible resistors is possible, manufacturing a fusible resistor with a resistance lower than 0.1 Ω is difficult due to limitations of the manufacturing process. Further, fabricating a fusible resistor with a resistance below 0.22 Ω is very difficult since the trimming causes an increase of the resistance of the fusible resistor.

Where a current exceeding a predetermined range flows through the circuit of an electronic device, a conventional fusible resistor generates excessive heat. To overcome this drawback, increasing the rated current of a fusible resistor or using a micro fuse instead of the fusible resistor have been proposed. However, increasing the rated current results in an increase of the size of the fusible resistor. Further, using a micro fuse is not cost effective because mass-production of micro fuses is limited due to the structural characteristic of a micro fuse and expensive raw materials required.

DISCLOSURE OF THE INVENTION

Therefore, an objective of the present invention is to provide a fusible resistor and method of fabricating the same, wherein the fusible resistor is inexpensive and has excellent resistance and fusible characteristics, without increasing the size of the fusible resistor when the rated current thereof is increased.

In accordance with one aspect of the present invention, there is provided a fusible resistor comprising a resistor body; a fusible element layer, which surrounds the resistor body and is fusible when a current over a predetermined current value is applied to the resistor body; caps, which surround ends of the fusible element layer; lead wires, which are attached to the caps; and an insulating layer for insulating the fusible element layer and the caps.

In accordance with another aspect of the present invention, there is provided a method of fabricating a fusible resistor comprising the steps of: preparing a resistor body; forming a fusible element layer, which surrounds the resistor body and is fusible when a current over a predetermined current value is applied to the resistor body; forming caps, which surround ends of the fusible element layer; forming lead wires, which are attached to the caps; and forming an insulating layer for insulating the fusible element layer and the caps.

MODES FOR CARRYING OUT THE INVENTION

A detailed description of the preferred embodiment of the present invention will follow with reference to the accompanying drawings.

Figure 1A:
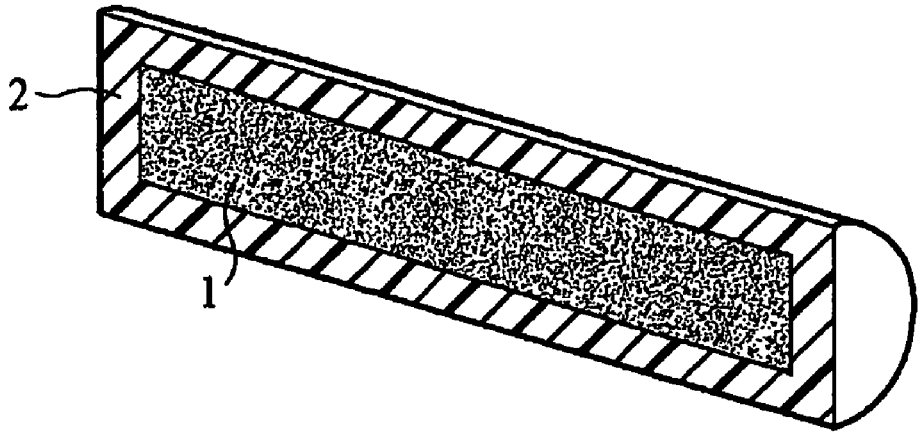
FIGS. 1A to 1F are perspective views of each step of fabricating a fusible resistor in accordance with a preferred embodiment of the present invention.

As shown in FIG. 1A, conductive layer 2 made of a conductive material is deposited on resistor body 1, which is in the form of a rod. In this embodiment, resistor body 1 is made of a material such as a highly pure ceramic. The conductive material of conduction layer 2 includes nickel-chromium and is deposited on resistor body 1 via plating, e.g., an electroless plating, which has been used in conventional fusible resistor fabrication.

Figure 1B:
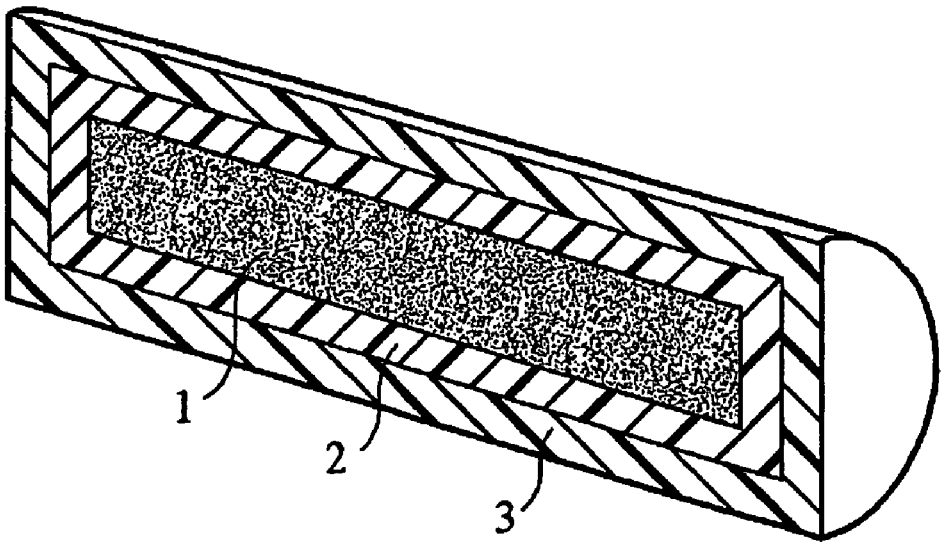

Fusible element layer 3 having fusible characteristics is deposited on conductive layer 2 (FIG. 1B). Fusible element layer 3 fuses from the heat generated when an excessive current flows through resistor body 1. The temperature coefficient is a critical factor determining fusible characteristics. Where a temperature coefficient is high, resistance of fusible element layer 3 increases due to heat generated when a current flowing through resistor body 1 is increased. As a result, the temperature of fusible element layer 3 increases to the melting point so that fusible element layer 3 is fused.

In this embodiment, a material including copper is used as fusible element layer 3. Copper is an electrically excellent fuse due to its high temperature coefficient, low resistivity, and low melting point. However, fusible element layer 3 may be made of any material, which has a temperature coefficient of over 2,000 ppm/° C. and a resistivity of $1\times10^{-8}$ to $50\times10^{-8}$ Ω·m (ohm meter).

Fusible element layer 3 may be deposited on conductive layer 2 via electrolysis plating. Instead of electrolysis plating, fusible element layer 3 may be directly deposited on resistor body 1 by sputtering. Where fusible element layer 3 is not deposited by electrolysis plating, conductive layer 2 may be omitted.

Figure 1C:
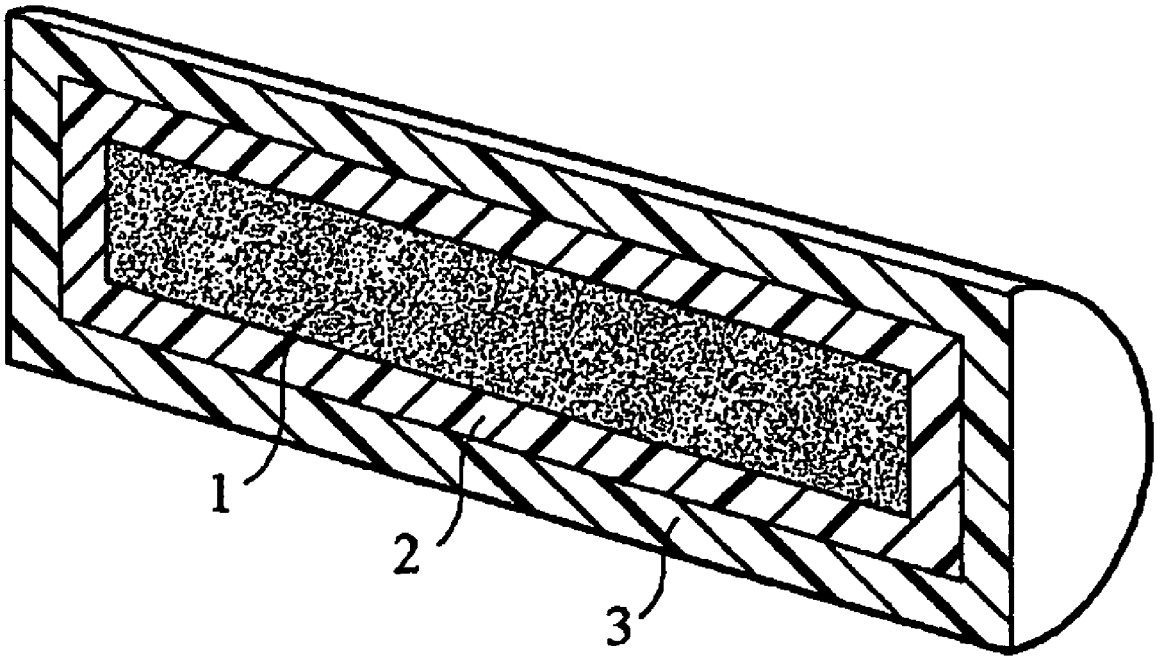

Anti-oxidation layer 4 is subsequently deposited on fusible element layer 3 in order to prevent oxidation of fusible element layer 3 in the atmosphere (FIG. 1C). For example, anti-oxidation layer 4 is formed by spray depositing a silver paste on fusible element layer 3. Instead of depositing anti-oxidation layer 4 on fusible element layer 3, a protection layer made of, for example, silicon paint may be deposited directly on fusible element layer 3. However, using anti-oxidation layer 4 is more advantageous since fusible element layer 3 may be oxidized in the atmosphere during the fabrication process. Resistance of first structure 10, which is comprised of three layers 2, 3, and 4, is defined by the kind and thickness of the materials consisting each of three layers 2, 3, and 4. In this embodiment of the present invention, the resistance is extremely low, approximately, less than 5 mΩ.

Figure 1D:
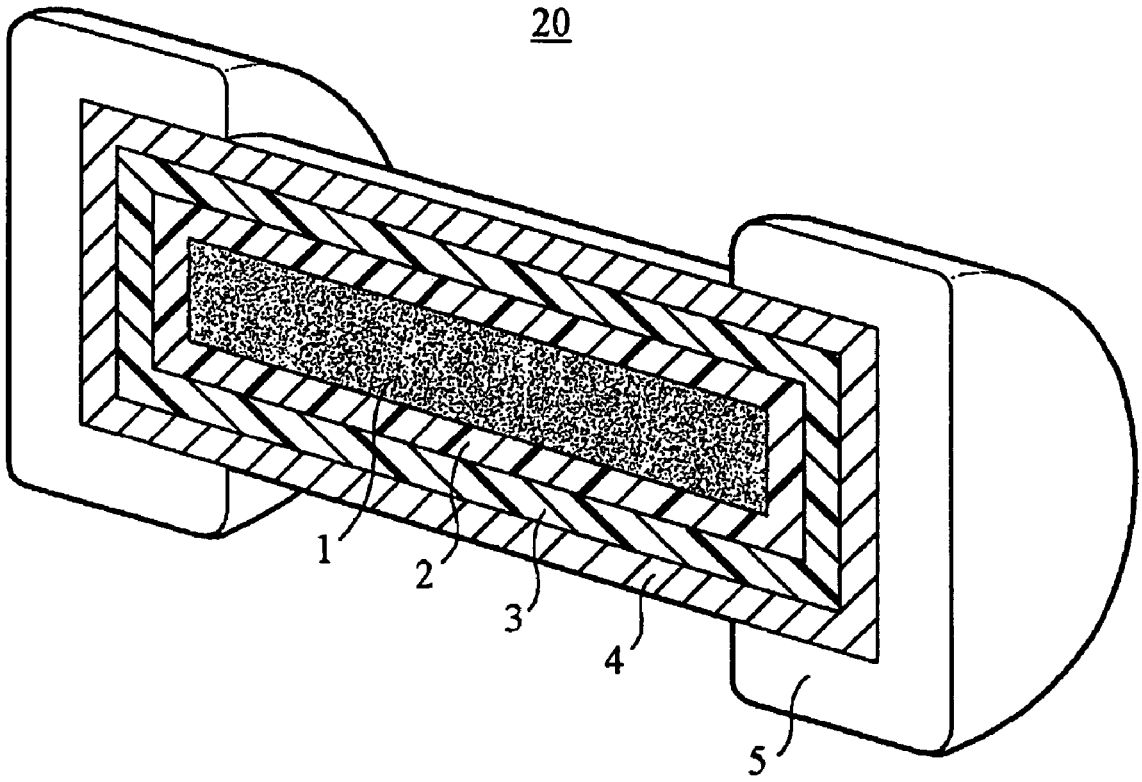

As illustrated in FIG. 1D, a second structure 20 is constructed by forming caps 5 of a conductive material, such as iron, to wrap both ends of first structure 10. Fusible element layer 3 is electrically connected, through caps 5, to outside via anti-oxidation layer 4. Resistance of second structure 20 is maintained in range of 1 to 15 mΩ.

Figure 1E:
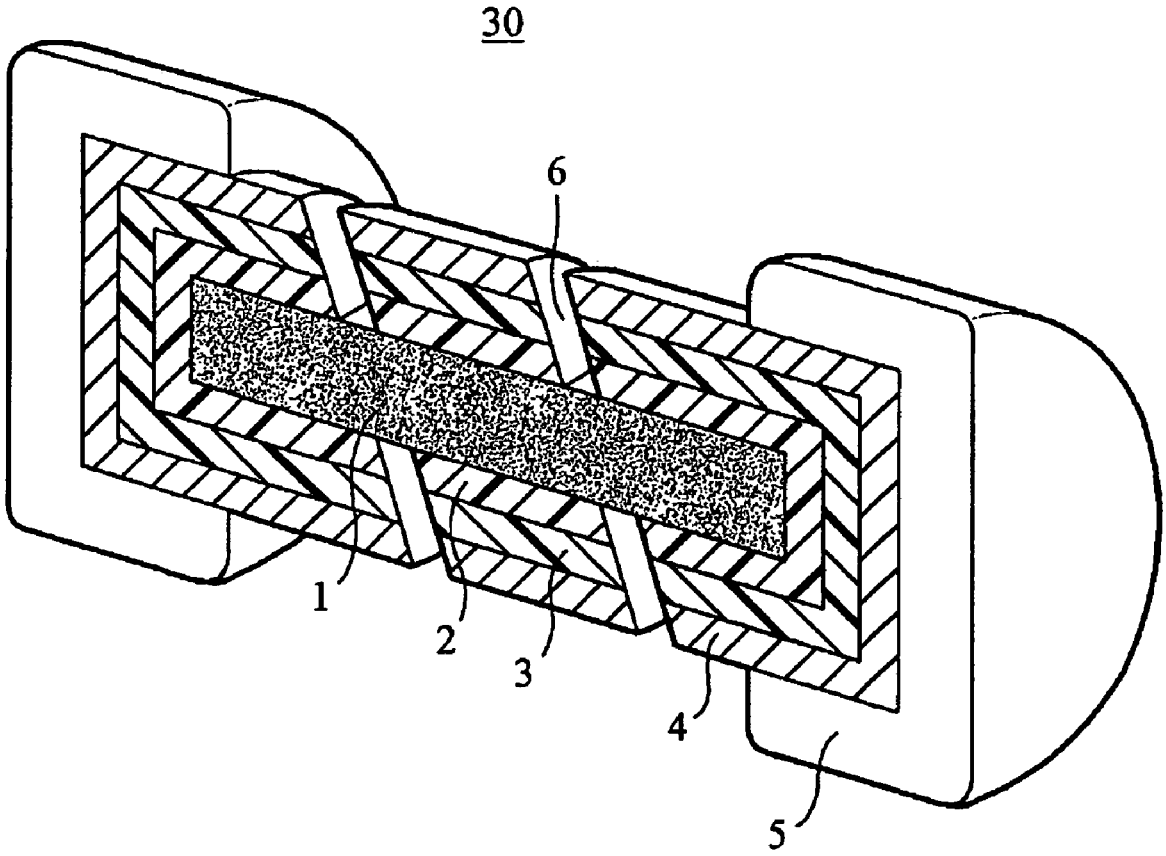

As illustrated in FIG. 1E, third structure 30 is constructed by forming a spiral groove 6, which penetrates layers 2, 3, and 4. Final resistance of third structure 30 is conventionally maintained in the range of 20 to 470 mΩ. This final resistance depends on the resistance of first structure 10 and the number of trimming turns. More particularly, the final resistance after trimming depends on the number of trimming turns. The number of trimming turns is determined as 1 to 2. According to the resistance dependent on the number of trimming turns, characteristics with respect to rated currents of fuse and the like are determined.

Figure 1F:
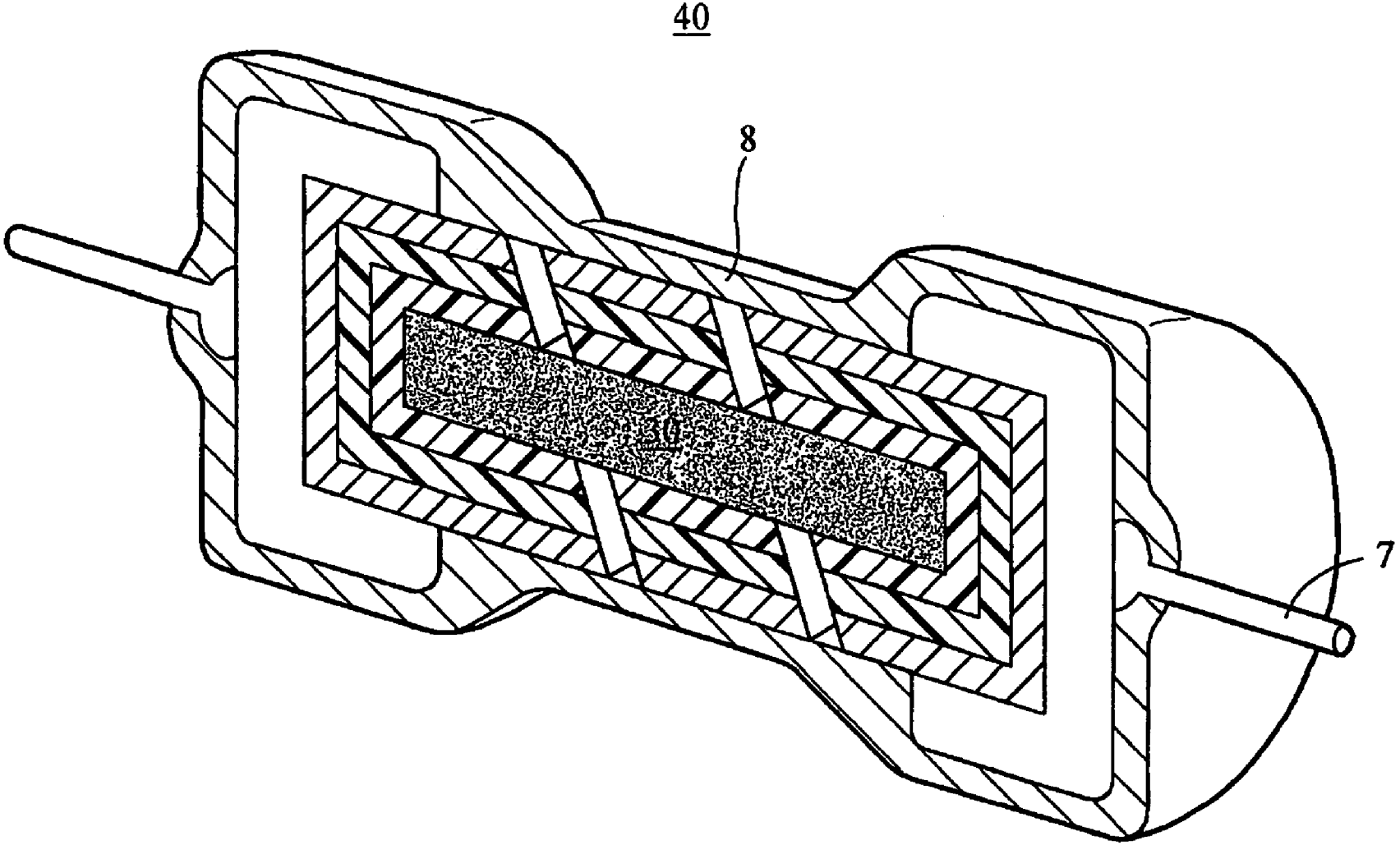

Finally, as illustrated in FIG. 1F, lead wire 7 is attached to an end of each of caps 5 by welding. Lead wire 7 electrically connects a circuit substrate to fusible element layer 3, wherein a resultant fusible resistor is to be installed on the circuit substrate. The resultant fusible resistor, i.e., fusible resistor 40 is constructed by coating an outside of third structure 30 with an insulating paint to form protective film layer 8. Herein, protective film layer 8 isolates fusible element layer 3 and caps 5 from the outside and protects components 1 to 6 within fusible resistor 40 from external impacts. An outer surface of protective film layer 8 is preferably formed of a noncombustible paint so as to indicate a rated current and the like of fusible resistor 40.

Figure 2:
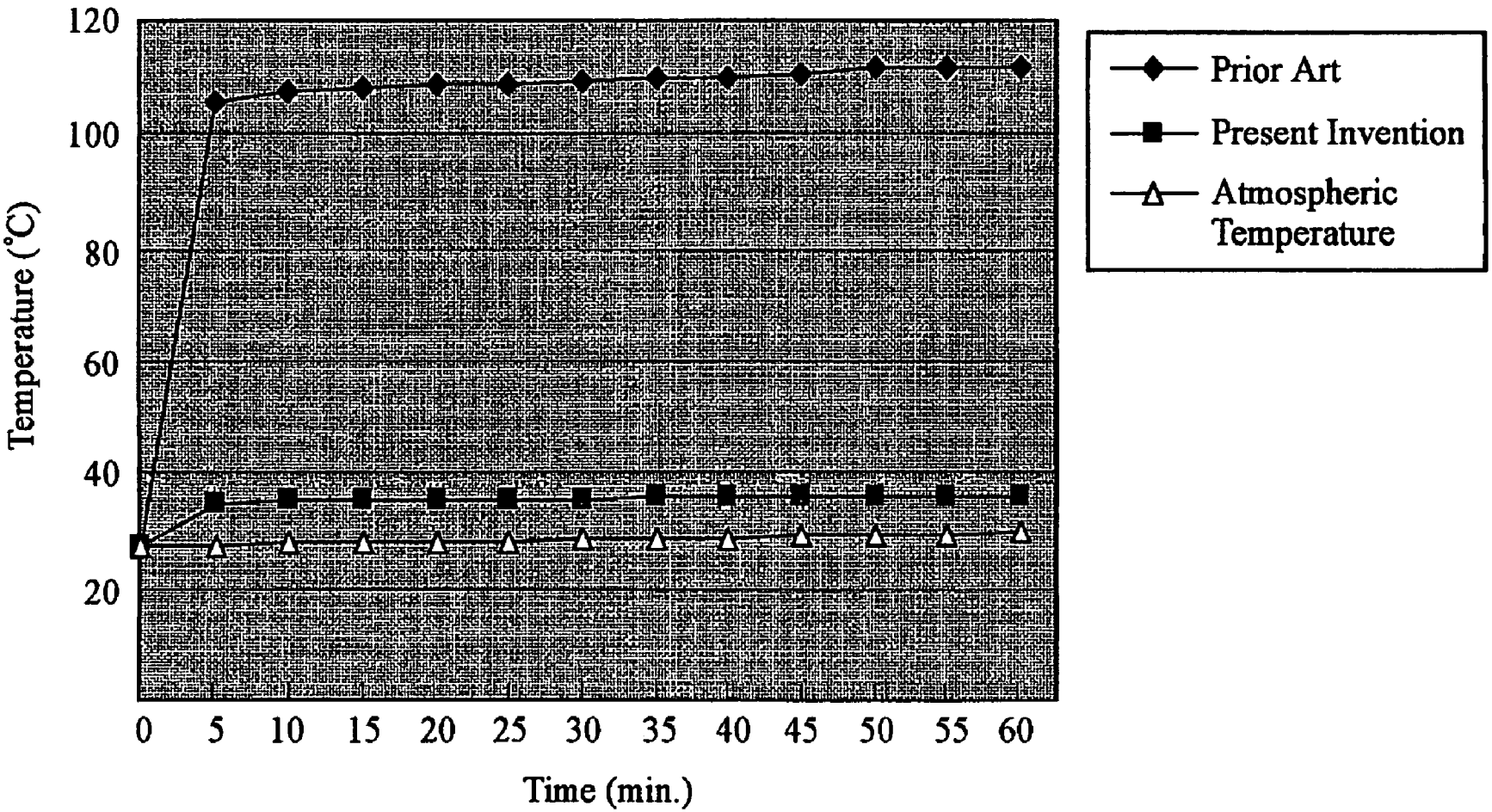
FIG. 2 is a graph of illustrating a measured temperature of a conventional fusible resistor and a fusible resistor in accordance with an embodiment of the present invention.

Referring to FIG. 2,in measuring temperature, a conventional fusible resistor fabricated by Smart Electronics, Inc. in Korea (Model No. FNS 2W, rated current of 2 watt (W), resistance of 0.47 Ω, 12 mm in length except lead wires) and a fusible resistor in accordance with an embodiment of the present invention fabricated by Smart Electronics, Inc. in Korea (Model No. SPF 1 W, rated current of 1 W, resistance of 0.02 Ω, and 6.5 mm in length except lead wires) are compared. Temperature is measured by coupling a temperature sensor to the lead wires and sensing, every 5 minutes, the temperature of each fusible resistor where a current of 2.5A is applied thereto. In measuring temperature, a temperature sensor of Yokogawa Electric Corporation in Japan (Model No. μ1800) is employed.

As illustrated in FIG. 2, heat generated on the conventional fusible resistor rises from 27.5° C. to 105.8° C. after 5 minutes to reach 112.2° C. after 1 hour, while temperature of the fusible resistor in accordance with an embodiment of the present invention rises from 27.5° C. only to 34.8° C. after 5 minutes to reach only 36.1° C. after 1 hour.

In general, the temperature of the fusible resistor falls as its rated current increases. However, in accordance an embodiment of the present invention, the temperature and its range of the fusible resistor are remarkably lower than those of a conventional fusible resistor, in spite of having a rated current lower than that of the conventional fusible resistor. With the above advantageous features, the fusible resistor in accordance with an embodiment of the present invention is directly mounted on a circuit substrate to reduce the size of an electronic device.

Figure 3:
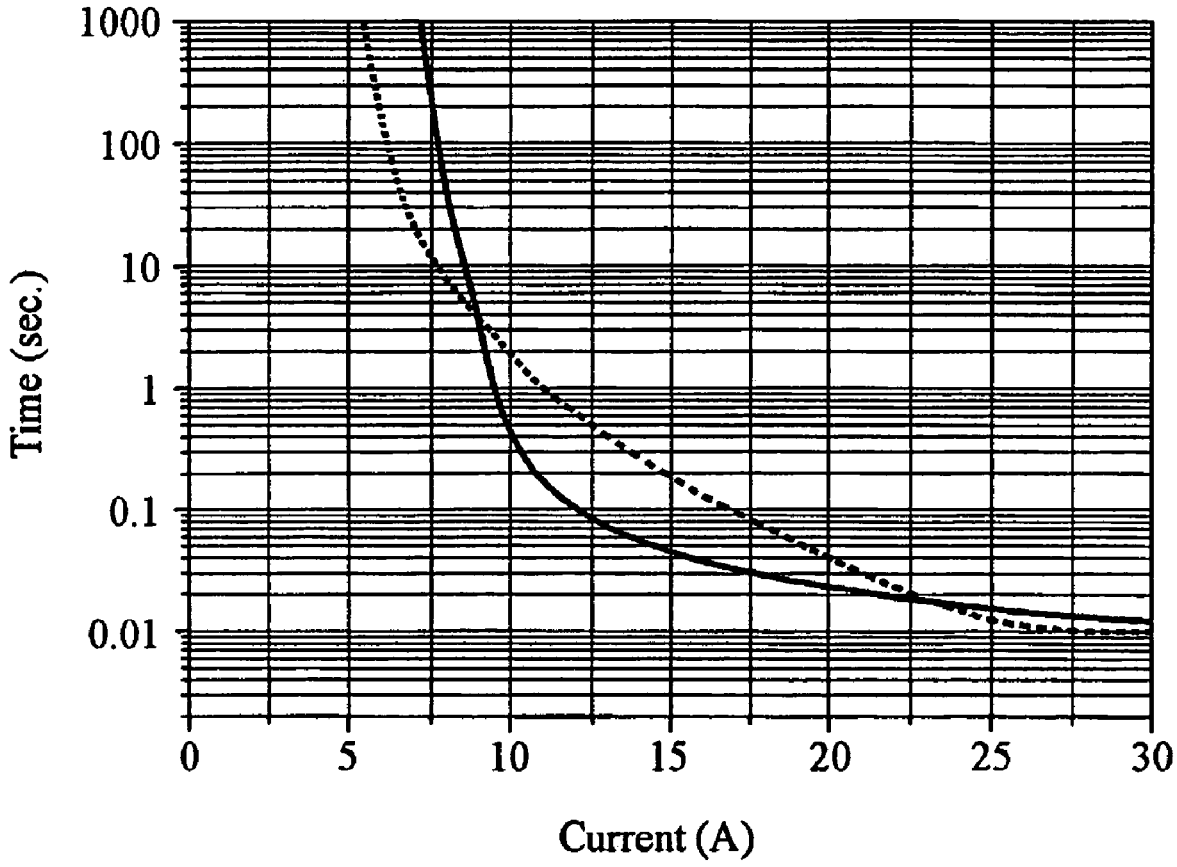
FIG. 3 is a graph of illustrating current-time characteristics of a conventional fusible resistor and a fusible resistor in accordance with an embodiment of the present invention.

Referring to FIG. 3, the dotted line and solid line represent current-time characteristics with respect to the resistance of the conventional fusible resistor and the fusible resistor in accordance with an embodiment of the present invention, respectively. The fusible resistors used for measurement of current-time characteristics are identical to those used for measurement of temperature, described above with reference to FIG. 2.

INDUSTRIAL APPLICABILITY

As described above, the present invention provides a fusible resistor having a very low resistance, e.g., from 20 to 470 mΩ, by depositing a fusible element layer made of a material such as copper, which has a temperature coefficient of 2,000 ppm/° C. and low resistivity, on a resistor body. A fusible resistor in accordance with an embodiment of the present invention having low resistance does not overheat during an overload.

Thus, a fusible resistor in accordance with an embodiment of the present invention can be used for blocking an excessive current induced by instantaneous short phenomenon of a diode, a capacitor, and a transistor in an excessive current preventing circuit. Further, such a fusible resistor can be replaced by a conventional resistor having a resistance of 0.1 to 2 Ω, depending on the minimum current of each wire on an electronic circuit. Furthermore, the method of fabricating the fusible resistor in accordance with the present invention can be implemented without additional investment of equipment for manufacturing the fusible resistor since it adapts conventional fabricating methods. Accordingly, the fabricating method in accordance with an embodiment of the present invention has high productivity.

While the present invention has been shown and described with respect to the particular embodiments, those skilled in the art will recognize that many changes and modifications may be made without departing from the scope of the invention as defined in the appended claims.

The invention claimed is:

1. A fusible resistor, comprising:

a resistor body;

a fusible element layer, which surrounds the resistor body and is fusible when a current over a predetermined current value is applied to the resistor body, the fusible element layer comprising a material having a temperature coefficient of over 2,000 ppm/° C. and a resistivity of $1\times10^{-8}$ to $50\times10^{-8}$ Ω·m (ohm/meter);

caps, which surround ends of the fusible element layer;

lead wires, which are attached to the caps; and an insulating layer for insulating the fusible element layer and the caps.

2. The fusible resistor of claim 1, wherein the fusible element layer further comprises at least copper.

3. The fusible resistor of claim 1, further comprising an anti-oxidation layer, which surrounds the fusible element layer.

4. The fusible resistor of claim 3, wherein the anti-oxidation layer further comprises at least a silver paste.

5. The fusible resistor of claim 1, further comprising a conductive layer, which is formed between the resistor body and the fusible element layer and made of a conductive material.

6. The fusible resistor of claim 5, wherein the conductive layer further comprises at least nickel and chrome.

7. The fusible resistor of claim 5, further comprising a groove, which is formed through the fusible element layer, an anti-oxidation layer associated with the fusible element layer, and the conductive layer to reach the resistor body.

8. The fusible resistor of claim 7, wherein the groove is in the form of a spiral along a circumference of the fusible resistor.

9. A method of fabricating a fusible resistor, comprising the steps of:

preparing a resistor body;

forming a fusible element layer, which surrounds the resistor body and is fusible when a current over a predetermined current value is applied to the resistor body, the fusible element comprising a material having a temperature coefficient of over 2,000 ppm/° C. and a resistivity of $1\times10^{-8}$ to $50-10^{-8}$ Ω·m (ohm/meter);

forming caps, which surround ends of the fusible element layer;

forming lead wires, which are attached to the caps; and forming an insulating layer for insulating the fusible element layer and the caps.

10. The method of claim 9, wherein the fusible element layer further comprises at least copper.

11. The method of claim 9, further comprising a step of forming an anti-oxidation layer, which surrounds the fusible element layer.

12. The method of claim 11, wherein the anti-oxidation layer further comprises at least a silver paste.

13. The method of claim 9, further comprising a step of forming a conductive layer, which is formed between the resistor body and the fusible element layer and made of a conductive material.

14. The method of claim 13, wherein the conductive layer further comprises at least nickel and chrome.

15. The method of claim 13, further comprising a step of forming a groove, which is formed through the fusible element layer, an anti-oxidation layer associated with the fusible element layer, and the conductive layer to reach the resistor body.

16. The method of claim 15, wherein the groove is in the form of a spiral along a circumference of the fusible resistor.

17. The fusible resistor of claim 3, further comprising a conductive layer, which is formed between the resistor body and the fusible element layer and made of a conductive material.

18. The method of claim 11, further comprising a step of:

forming a conductive layer, which is formed between the resistor body and the fusible element layer and made of a conductive material.

* * * * *